US010098448B1

(12) United States Patent
Beach

(10) Patent No.: US 10,098,448 B1
(45) Date of Patent: Oct. 16, 2018

(54) TOOTHBRUSH TIMER

(71) Applicant: Timothy Beach, Carmel, NY (US)

(72) Inventor: Timothy Beach, Carmel, NY (US)

( * ) Notice: Subject to any disclaimer, the term of this patent is extended or adjusted under 35 U.S.C. 154(b) by 0 days.

(21) Appl. No.: 15/689,078

(22) Filed: Aug. 29, 2017

(51) Int. Cl.
*G04B 47/00* (2006.01)
*A46B 15/00* (2006.01)

(52) U.S. Cl.
CPC ..... *A46B 15/0046* (2013.01); *G04B 47/00* (2013.01); *A46B 2200/1066* (2013.01)

(58) Field of Classification Search
CPC .. G04B 47/068; G04B 47/06; G04B 15/0046; A46B 15/0046; A46B 2200/1066
See application file for complete search history.

(56) References Cited

U.S. PATENT DOCUMENTS 4,866,807 A * 9/1989 Kreit ..... A46B 15/0002 15/105
5,044,037 A * 9/1991 Brown ..... A46B 15/0002 15/105
5,259,086 A * 11/1993 Fong ..... A46B 15/0002 15/105
5,438,726 A 8/1995 Leite
5,894,453 A * 4/1999 Pond ..... A46B 15/0002 15/105
5,960,507 A 10/1999 Dutra
6,029,303 A 2/2000 Dewan
6,081,957 A 7/2000 Webb
6,154,912 A * 12/2000 Li ..... A46B 15/0002 15/105
6,202,242 B1 * 3/2001 Salmon ..... A46B 5/00 15/105
6,202,245 B1 * 3/2001 Khodadadi ..... A46B 15/0002 15/105
6,345,015 B1 2/2002 Coulson
6,954,961 B2 * 10/2005 Ferber ..... A61C 17/22 15/105
D667,247 S 9/2012 Lawer
8,387,195 B2 * 3/2013 Patel ..... A46B 15/0002 15/105
9,084,472 B2 * 7/2015 Patel ..... A46B 15/0002
9,427,078 B2 * 8/2016 Farrell ..... A46B 7/04
2006/0037158 A1 * 2/2006 Foley ..... A46B 9/026 15/105
2008/0109973 A1 * 5/2008 Farrell ..... A46B 7/04 15/4
2009/0219787 A1 * 9/2009 Ortega ..... A46B 15/0002 368/10

(Continued)

FOREIGN PATENT DOCUMENTS

WO WO2007068984 A * 6/2007

*Primary Examiner* — Sean Kayes

(57) ABSTRACT

The toothbrush timer is a timing device that is configured for use with a toothbrush. The toothbrush is further defined with a bristle end and a grip end. The toothbrush timer removably attaches to the grip end of the toothbrush. The timing device is a countdown timer that times the duration of brushing activities. The toothbrush timer comprises a toothbrush, a sheath, and a timing circuit. The timing circuit is contained within the sheath. The sheath attaches to the toothbrush. To use the toothbrush timer, the timing circuit is initiated and the toothbrush is used normally until the timing circuit has completed its countown.

10 Claims, 4 Drawing Sheets

(56) References Cited

U.S. PATENT DOCUMENTS

| | | | | |
|---|---|---|---|---|
| 2009/0262606 | A1* | 10/2009 | Trost | A46B 15/0002 368/10 |
| 2011/0035888 | A1* | 2/2011 | Patel | A46B 15/0002 15/22.1 |
| 2013/0139334 | A1* | 6/2013 | Patel | A46B 15/0002 15/105 |
| 2014/0199651 | A1* | 7/2014 | Adachi | A61C 17/20 433/27 |
| 2017/0020277 | A1* | 1/2017 | Barnes | A61C 17/3436 |
| 2017/0318954 | A1* | 11/2017 | Nishiura | A46B 15/0006 |

* cited by examiner

TOOTHBRUSH TIMER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including brushes, more specifically, a brush with a means for controlling the duration of brushing.

SUMMARY OF INVENTION

The toothbrush timer is a timing device that is configured for use with a toothbrush. The toothbrush is further defined with a bristle end and a grip end. The toothbrush timer removably attaches to the grip end of the toothbrush. The timing device is a countdown timer that times the duration of brushing activities. The toothbrush timer comprises a toothbrush, a sheath, and a timing circuit. The timing circuit is contained within the sheath. The sheath attaches to the toothbrush. To use the toothbrush timer, the timing ciruit is initiated and the toothbrush is used normally until the timing circuit has completed its countdown.

These together with additional objects, features and advantages of the toothbrush timer will be readily apparent to those of ordinary skill in the art upon reading the following detailed description of the presently preferred, but nonetheless illustrative, embodiments when taken in conjunction with the accompanying drawings.

In this respect, before explaining the current embodiments of the toothbrush timer in detail, it is to be understood that the toothbrush timer is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the toothbrush timer.

It is therefore important that the claims be regarded as including such equivalent construction insofar as they do not depart from the spirit and scope of the toothbrush timer. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
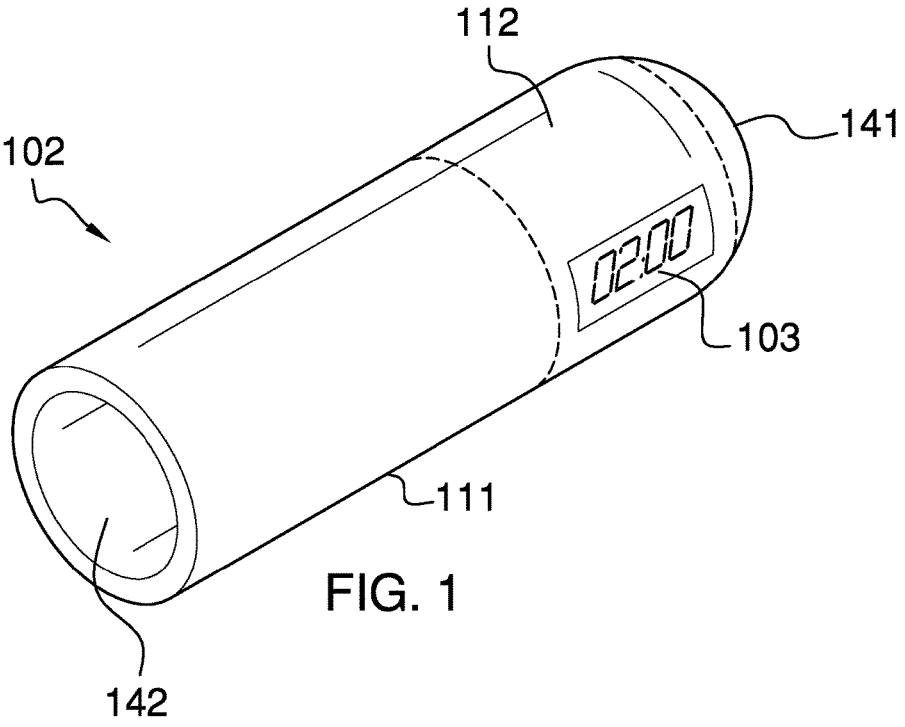
FIG. 1 is a perspective view of an embodiment of the disclosure.
Figure 2:
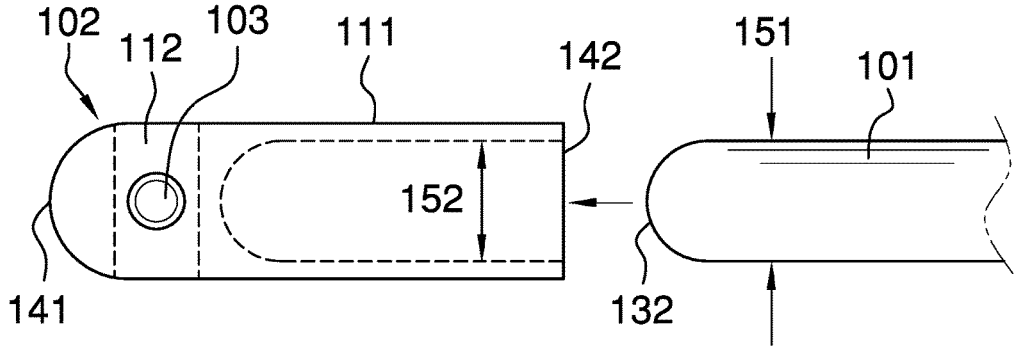
FIG. 2 is a rear view of an embodiment of the disclosure.
Figure 3:
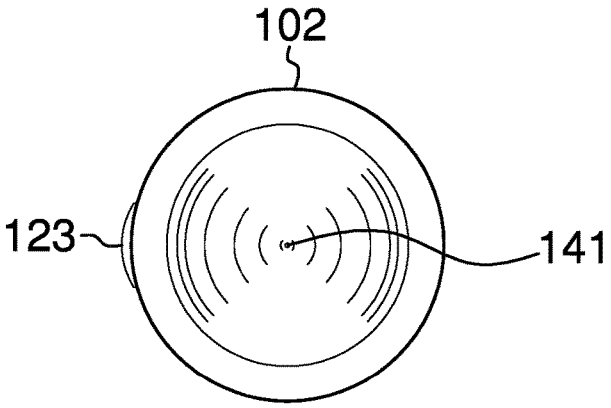
FIG. 3 is an end view of an embodiment of the disclosure.
Figure 4:
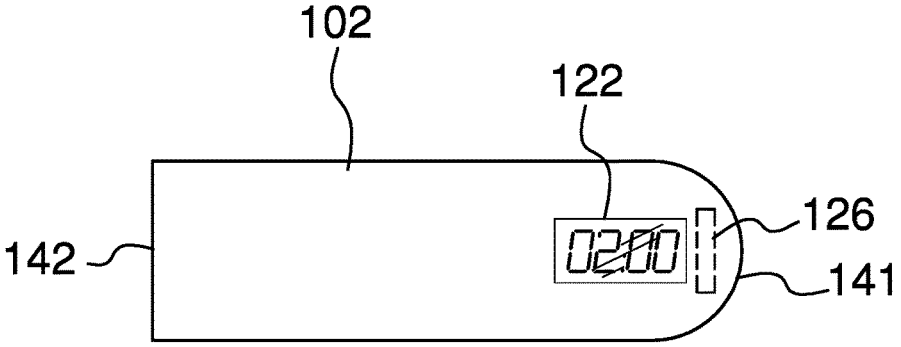
FIG. 4 is a front view of an embodiment of the disclosure.
Figure 5:
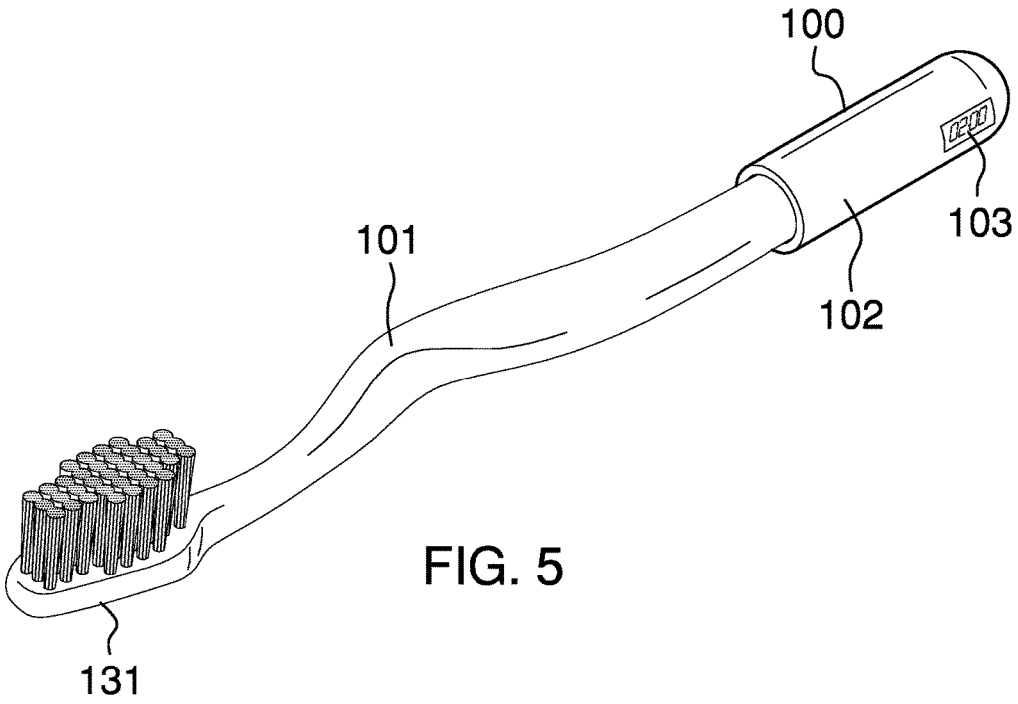
FIG. 5 is an in use view of an embodiment of the disclosure.
Figure 6:
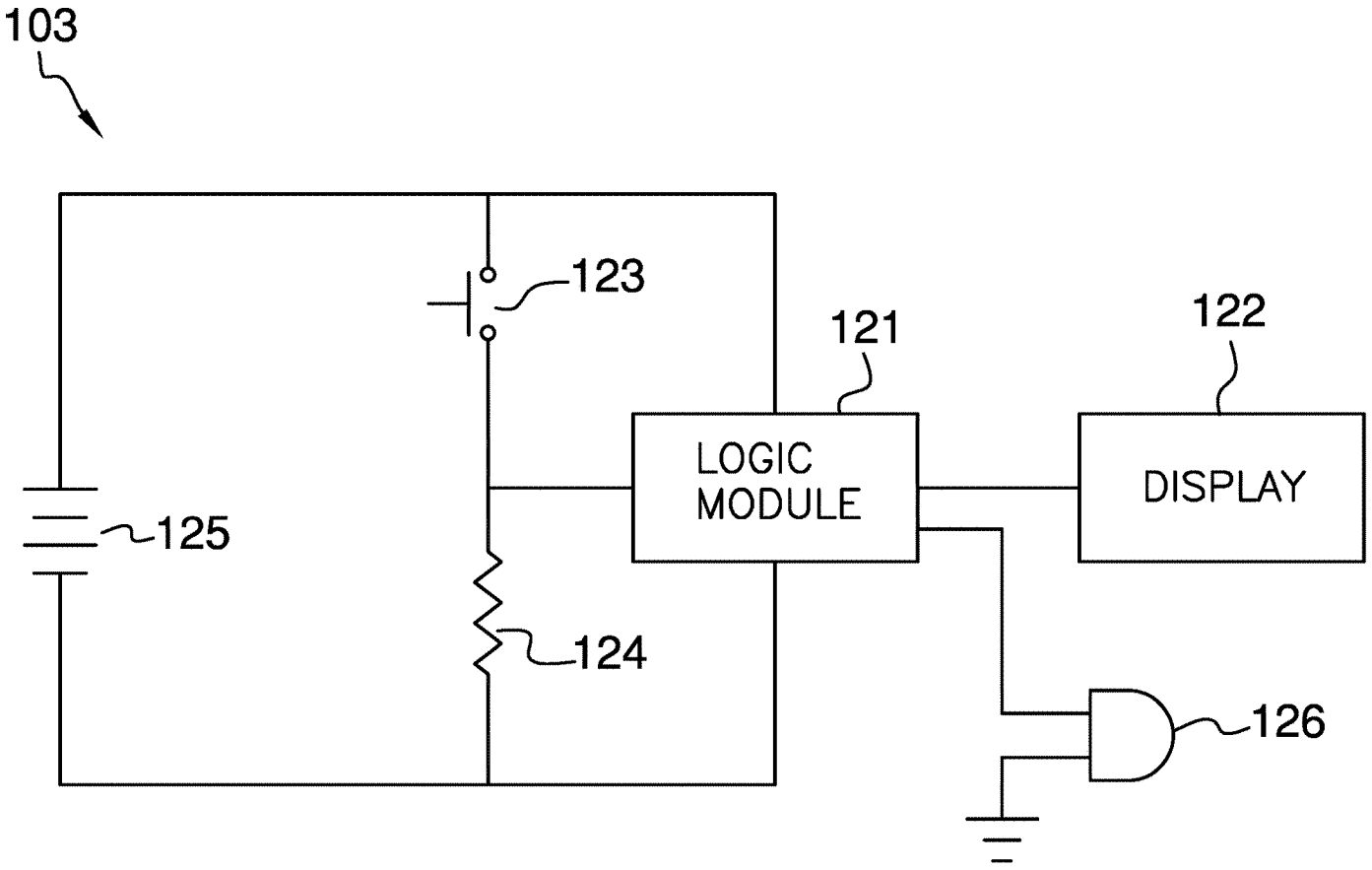
FIG. 6 is a block diagram or schematic view of an embodiment of the disclosure.

Detailed reference will now be made to one or more potential embodiments of the disclosure, which are illustrated in FIGS. 1 through 6.

The toothbrush timer 100 (hereinafter invention) is a timing device configured for use with a toothbrush 101. The toothbrush 101 is further defined with a bristle end 131 and a grip end 132. The invention 100 removably attaches to the grip end 132 of the toothbrush 101. The timing device is a countdown timer that times the duration of brushing activities. The invention 100 comprises a toothbrush 101, a sheath 102, and a timing circuit 103. The timing circuit 103 is contained within the sheath 102. The sheath 102 attaches to the toothbrush 101. To use the invention 100, the timing circuit 103 is initiated and the toothbrush 101 is used normally until the timing circuit 103 has completed its countdown.

The toothbrush 101 is a commercially available toothbrush 101 commonly used in oral hygiene activities. The toothbrush 101 is further defined with an outer dimension 151. The bristle end 131 is the brush end of the toothbrush 101. The grip end 132 is the end of the toothbrush 101 that is distal from the bristle end 131.

The sheath 102 is a semi-rigid structure that: 1) attaches to the toothbrush 101; and, 2) contains the timing circuit 103. The sheath 102 comprises a sleeve 111 and a housing cavity 112. The sleeve 111 is further defined with a closed end 141 and an open end 142.

The sleeve 111 is a hollow prism shaped structure. The sleeve 111 is formed in the manner of a capped tube. The capped tube of the sleeve 111 is further defined with an inner dimension 152. The sleeve 111 is formed as a semi-rigid structure further comprises an elastic nature. The grip end 132 of the toothbrush 101 inserts into the open end 142 of the sleeve 111.

The outer dimension 151 of the grip end 132 of the toothbrush 101 is greater than the inner dimension 152 of the open end 142 of the sleeve 111 such that the sleeve 111 will deform when the grip end 132 of the toothbrush 101 is inserted into the open end 142 of the sleeve 111. Specifically, when the grip end 132 of the toothbrush 101 is inserted into open end 142 of the sleeve 111 of the sheath 102, the open end 142 of the sleeve 111 of the sheath 102 deforms.

The elastic nature of the semi-rigid structure of the sleeve 111 creates a first displacing force that opposes the displacement created by insertion of the grip end 132 of the toothbrush 101 into the open end 142 of the sleeve 111 of the sheath 102. The first displacing force places an opposing force on the grip end 132 of the toothbrush 101 in the direction that returns the open end 142 of the sleeve 111 of the sheath 102 to its relaxed shape. This spring like action produces a clamping force that holds the grip end 132 of the toothbrush 101 securely within open end 142 of the sleeve 111 of the sheath 102.

In the first potential embodiment of the hollow prism shaped structure of the sleeve 111 is a rectangular prism.

The housing cavity 112 is a negative space formed within the sleeve 111. The housing cavity 112 contains the timing circuit 103. The housing cavity 112 is formed with all apertures and form factors necessary to allow the housing cavity 112 to accommodate the use and operation of the timing circuit 103. Methods to form cavities in semi-rigid structures are well-known in the mechanical and casting arts.

The timing circuit 103 is a countdown timer that is used to measure the amount of time spent in oral hygiene activities. Once the timing circuit 103 has completed the countdown timer cycle, a buzzer 126 is activated which causes the sheath 102 to vibrate creating a tactile indication that oral hygiene activities can terminate. In the first potential embodiment of the disclosure, the timing circuit 103 sets the countdown period to two minutes. Those skilled in the art will recognize that the countdown period can be readily adjusted without undue experimentation. The timing circuit 103 comprises a logic module 121, a display 122, a switch 123, a pull-down resistor 124, a battery 125, and a buzzer 126.

The logic module 121 is a programmable electrical device. The logic module 121: 1) initiates and manages the operation of the countdown timer; 2) displays the time remaining on the countdown timer on a display 122 mounted in the sleeve 111; and, 3) initiates the operation of the buzzer 126 when the countdown timer has expired. In the first potential embodiment of the disclosure, the logic module 121 is a microcontroller. Methods to use microcontrollers to perform the functions of the timing circuit 103 are well known and documented in the electrical arts.

The display 122 is an electrical device that the logic module 121 uses to display the time remaining on the countdown timer. In the first potential embodiment of the disclosure, the display 122 is a commercially available seven segment LED display comprising three or more digits. Methods to use a microcontroller to drive a seven segment LED display are well known, documented and commercially available in the electrical arts.

The switch 123 is a normally open momentary switch. The switch 123 connects in series between the battery 125 and the pull-down resistor 124. As shown most clearly in FIG. 6, when the switch 123 closes, the switch 123 completes an electric circuit that presents a voltage across the pull-down resistor 124.

The voltage across the pull-down resistor 124 is monitored by the logic module 121. When the logic module 121 detects a voltage across the pull-down resistor 124, the logic module 121 initiates the operation of the countdown timer. The pull-down resistor 124 is a commercially available two lead electrical device that is described in greater detail elsewhere in this disclosure.

The battery 125 is a commercially available chemical device that is used to generate electrical power. The buzzer 126 is a two lead electrical device that vibrates when a voltage is presented across the two leads of the buzzer 126. The buzzer 126 is actuated by the logic module 121 once the countdown period has elapsed.

The following definitions were used in this disclosure:

Battery: As used in this disclosure, a battery is a chemical device consisting of one or more cells, in which chemical energy is converted into electricity and used as a source of power.

Buzzer: As used in this disclosure, a buzzer is two lead electrical device that generates an audible sound when a voltage is applied to the two leads.

Capped Tube: As used in this disclosure, a capped tube is a tube with one closed end and one open end.

Cavity: As used in this disclosure, a cavity is an empty space or negative space formed within an object.

Display: As used in this disclosure, a display is a surface upon which is presented an image, potentially including, but not limited to, graphic images and text, that is interpretable by an individual viewing the projected image in a meaningful manner.

Elastic: As used in this disclosure, an elastic is a material or object that deforms when a force is applied to it and that returns to its relaxed shape after the force is removed. A material that exhibits these qualities is referred to as an elastomeric material.

Form Factor: As used in this disclosure, the term form factor refers to the size and shape of an object.

Housing: As used in this disclosure, a housing is a rigid casing that encloses and protects one or more devices.

Inner Dimension: As used in this disclosure, the term inner dimension describes the span from a first inside or interior surface of a container to a second inside or interior surface of a container. The term is used in much the same way that a plumber would refer to the inner diameter of a pipe.

Logic Module: As used in this disclosure, a logic module is a readily and commercially available electrical device that is programmable and that accepts digital and analog inputs, processes the digital and analog inputs according to previously stored instruction and provides the results of these instructions as digital or analog outputs.

Microcontroller: As used in this disclosure, a microcontroller is a small computer, often on a single integrated circuit, containing a processor core, memory, and programmable input/output peripherals.

Momentary Switch: As used in this disclosure, a momentary switch is a biased switch in the sense that the momentary switch has a baseline position that only changes when the momentary switch is actuated (for example when a push button switch is pushed). The momentary switch then returns to the baseline position once the actuation is completed. This baseline position is called the "normal" position. For example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

Negative Space: As used in this disclosure, negative space is a method of defining an object through the use of open or empty space as the definition of the object itself, or, through the use of open or empty space to describe the boundaries of an object.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Prism: As used in this disclosure, a prism is a 3-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called that lateral faces. In this disclosure, when further description is required a prism is named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous the center axis of a cylinder. A prism wherein the ends are circles is commonly referred to as a cylinder.

Pull-Down Resistor: As used in this disclosure, a pull-down resistor is an electrical resistor used in a switching or logic to present a predetermined signal voltage to an externally provided logic circuit.

Relaxed Shape: As used in this disclosure, a structure is considered to be in its relaxed state when no shear, strain, or torsional forces are applied to the structure.

Resistor: As used in this disclosure, a resistor is a well-known and commonly available electrical device that inhibits the flow of electricity through an electric circuit. Within an electric circuit processing alternating currents, the resistor will not affect the phase of the alternating current. A current flowing through a resistor will create a voltage across the terminals of the resistor.

Semi-Rigid Structure: As used in this disclosure, a semi-rigid structure is a solid structure that is stiff but not wholly inflexible and that will deform under force before breaking. A semi-rigid structure may or may not behave in an elastic fashion in that a semi-rigid structure need not return to a relaxed shape.

Sheath: As used in this disclosure, a sheath is a shell that is used to cover an object and into which the object may be inserted and withdrawn.

Sleeve: As used in this disclosure, a sleeve is a tube like covering that is placed over a rod, shaft or other cylindrical object.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Timing Circuit: As used in this disclosure, a timing circuit refers to an electrical network of interconnected electrical elements, potentially including but not limited to, resistors, capacitors, diodes, transistors, and integrated circuit devices. The purpose of the timing circuit is to generate an electrical control signal after a predetermined amount of time. In common usage, a timing circuit is also referred to as timing circuitry.

Timing Device: As used in this disclosure, a timing device is an automatic mechanism for activating or deactivating a device at a specific time or after a specific period of time.

Tube: As used in this disclosure, a tube is a hollow prism shaped device used for transporting liquids and gases. The line that connects the center of the first base of the cylinder to the center of the second base of the cylinder is referred to as the center axis of the tube or the centerline of the tube. In this disclosure, the terms inner dimensions of a tube and outer dimensions of a tube are used as they would be used by those skilled in the plumbing arts.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A timing device comprising:

a toothbrush, a sheath, and a timing circuit;

wherein the timing circuit is contained within the sheath;

wherein the timing device is configured for use with a toothbrush;

wherein the toothbrush is further defined with a bristle end and a grip end;

wherein the toothbrush is further defined with an outer dimension;

wherein the sheath removably attaches to the grip end of the toothbrush;

wherein the sheath is a semi-rigid structure;

wherein the timing circuit is a countdown timer;

wherein the countdown timer times the duration of brushing activities;

wherein the countdown timer measures the amount of time spent in oral hygiene activities;

wherein once timing circuit creates a vibration to indicate that the countdown timer has expired;

wherein the sheath comprises a sleeve and a housing cavity;

wherein the housing cavity is a negative space formed within the sleeve;

wherein the sleeve is further defined with a closed end and an open end;

wherein the grip end of the toothbrush inserts into the open end of the sleeve;

wherein the sleeve is formed in the manner of a capped tube;

wherein the capped tube of the sleeve is further defined with an inner dimension;

wherein the sleeve is formed as a semi-rigid structure;

wherein the semi-rigid structure further comprises an elastic nature;

wherein the outer dimension of the grip end of the toothbrush is greater than the inner dimension of the open end of the sleeve;

wherein the sleeve will deform when the grip end of the toothbrush is inserted into the open end of the sleeve;

wherein the semi-rigid structure creates a clamping force that holds the grip end of the toothbrush within the open end of the sleeve of the sheath;

wherein the housing cavity contains the timing circuit;

wherein the timing circuit comprises a logic module, a display, a switch, a pull-down resistor, a battery, and a buzzer;

wherein the logic module, the display, the switch, the pull-down resistor, the battery, and the buzzer are electrically interconnected.

2. The timing device according to claim 1 wherein the logic module is a programmable electrical device;

wherein the logic module initiates and manages the operation of the countdown timer;

wherein the logic module displays the time remaining on the countdown timer;

wherein the logic module initiates the operation of the buzzer.

3. The timing device according to claim 2 wherein the display is an electrical device;

wherein the display visibly displays the time remaining on the countdown timer;

wherein the display is operated by the logic module.

4. The timing device according to claim 3 wherein the switch is a normally open momentary switch.

5. The timing device according to claim 4 wherein the switch connects in series between the battery and the pull-down resistor.

6. The timing device according to claim 5 wherein the pull-down resistor is a two lead electrical device;

wherein the switch completes an electric circuit that presents a voltage across the pull-down resistor;

wherein the voltage across the pull-down resistor is monitored by the logic module;

wherein when the logic module detects a voltage across the pull-down resistor, the logic module initiates the operation of the countdown timer.

7. The timing device according to claim 6 wherein the buzzer is a two lead electrical device;

wherein the buzzer vibrates when a voltage is presented across the two leads of the buzzer;

wherein the buzzer is actuated by the logic module once the countdown period has elapsed.

8. The timing device according to claim 7 wherein the logic module is a microcontroller.

9. The timing device according to claim 8 wherein the display is a seven segment LED display;

wherein the seven segment LED display supports three or more digits.

10. The timing device according to claim 9 wherein the countdown period is two minutes.

* * * * *